US011980332B2

(12) United States Patent
Brodowski et al.

(10) Patent No.: US 11,980,332 B2
(45) Date of Patent: May 14, 2024

(54) DISHWASHER

(71) Applicant: ILLINOIS TOOL WORKS INC., Glenview, IL (US)

(72) Inventors: Björn Brodowski, Hohberg (DE); Matthias Kuderer, Durbach (DE)

(73) Assignee: ILLINOIS TOOL WORKS INC., Glenview, IL (US)

( * ) Notice: Subject to any disclaimer, the term of this patent is extended or adjusted under 35 U.S.C. 154(b) by 585 days.

(21) Appl. No.: 17/262,013

(22) PCT Filed: Jul. 23, 2019

(86) PCT No.: PCT/US2019/042923

§ 371 (c)(1),
(2) Date: Jan. 21, 2021

(87) PCT Pub. No.: WO2020/023440

PCT Pub. Date: Jan. 30, 2020

(65) Prior Publication Data

US 2021/0315440 A1 Oct. 14, 2021

(30) Foreign Application Priority Data

Jul. 26, 2018 (DE) ..... 10 2018 118 109.4

(51) Int. Cl.
*A47L 15/42* (2006.01)
*A47L 15/00* (2006.01)

(52) U.S. Cl.
CPC ..... *A47L 15/4229* (2013.01); *A47L 15/0076* (2013.01); *A47L 15/4217* (2013.01); *A47L 15/4223* (2013.01)

(58) Field of Classification Search
None
See application file for complete search history.

(56) References Cited

U.S. PATENT DOCUMENTS

2006/0266381 A1* 11/2006 Doherty ..... A47L 15/0065 134/29
2011/0005557 A1* 1/2011 Braun ..... A47L 15/4234 134/25.2
2013/0146087 A1* 6/2013 Everson ..... B01J 39/08 210/96.1

FOREIGN PATENT DOCUMENTS

CN 106889965 * 6/2017 ..... A47L 15/16
DE 20319711 * 5/2004 ..... A14L 15/4223

(Continued)

OTHER PUBLICATIONS

CN106889965 English translation, accessed on Jun. 2023. (Year: 2017).*

(Continued)

*Primary Examiner* — Eric W Golightly
*Assistant Examiner* — Arlyn I Rivera-Cordero
(74) *Attorney, Agent, or Firm* — Thompson Hine LLP

(57) ABSTRACT

A box-type dishwasher, wherein the dishwasher has a fresh-water connection with a feed valve, wherein a water-treatment system with a reverse-osmosis device is provided downstream of the feed valve in order to treat, in particular as required, as least some of the fresh water fed to the dishwasher via the fresh-water connection, wherein a back-flow preventer is provided between the feed valve and the reverse-osmosis device in order to prevent water from flowing back from the dishwasher into a fresh-water-supply installation which is, or can be, flow- connected to the fresh-water connection.

9 Claims, 2 Drawing Sheets

(56) References Cited

FOREIGN PATENT DOCUMENTS

| | | | |
|---|---|---|---|
| DE | 10352120 | A1 | 6/2005 |
| DE | 102005023429 | A1 | 11/2006 |
| DE | 102010053051 | | 6/2012 |
| DE | 102014119397 | A1 | 6/2016 |
| EP | 1452123 | A1 | 9/2004 |
| EP | 3037027 | | 6/2016 |
| WO | WO 2005046420 | | 5/2005 |
| WO | WO 2014031753 | | 2/2014 |

OTHER PUBLICATIONS

EP 3037027 English translation, accessed on Jun. 2023. (Year: 2016).*
WO2005/046420 English translation, accessed on Jun. 2023. (Year: 2005).*
DE20319711 English translation, accessed on Jun. 2023. (Year: 2013).*
PCT, International Search Report and Written Opinion, International Application No. PCT/US2019/042923; dated Oct. 2, 2019, 14 pages.

* cited by examiner

DISHWASHER

TECHNICAL FIELD

The present invention relates to a dishwasher, in particular commercial dishwasher, which is designed in the form of a box-type dishwasher.

BACKGROUND

Box-type dishwashers, which are also referred to in commercial dishwashing as "single-tank machines", are manually loadable and unloadable dishwashers. The box-type dishwashers may be dish-rack-type pass-through dishwashers, also called hood-type dishwashers, or front loaders. Front loaders may be undercounter machines, countertop machines or freestanding dishwashers with front loading configuration.

A dishwasher in the form of a box-type dishwasher normally has a treatment chamber for cleaning items of washware. In general, below the treatment chamber, there is arranged a wash tank into which liquid can flow back from the treatment chamber under the action of gravitational force. The wash tank contains washing liquid, which is commonly water, to which detergents may optionally be added. Furthermore, a dishwasher in the form of a box-type dishwasher normally has a wash system with a wash pump, with a line system connected to the wash pump, and with a multiplicity of spray nozzles formed in at least one wash arm. The washing liquid situated in the wash tank can be conveyed by the wash pump via the line system to the wash nozzles and sprayed through the wash nozzles in the treatment chamber onto the items of washware to be cleaned. The sprayed washing liquid subsequently flows back into the wash tank.

A dishwasher of this type in the form of a box-type dishwasher is known, for example, from the document DE 10 2005 023 429 A1.

The expression "items of washware" used herein is intended to be understood as meaning in particular dishes, glasses, cutlery, cooking utensils, baking utensils and serving trays.

Commercial dishwashers in the form of box-type dishwashers normally operate in two main process steps: a first step, which comprises washing using a washing liquid, and a second step, which comprises final rinsing using heated fresh water and rinsing agents to be metered in.

In order to be able to carry out said process step, a commercial dishwasher in the form of a box-type dishwasher is generally equipped with two independent liquid systems which are completely separated from each other. One liquid system is a wash water circuit which is responsible for washing the items of washware, wherein the washing is carried out using recirculated water from the wash tank of the dishwasher. The other liquid system is a fresh water system which is responsible for the final rinse. The final rinse is carried out using fresh water, preferably using fresh water from a water heater (boiler). The fresh water after being sprayed into the treatment chamber of the dishwasher is likewise received by the wash tank of the dishwasher.

The main object of the final rinse is to remove soapy water situated on the items of washware. In addition, the final rinse water flowing into the wash tank during the final rinse step serves for regenerating the wash water present in the wash tank.

Before fresh water as final rinse liquid is sprayed and thus conducted into the wash tank of the dishwasher as a result of the final rinse process, an amount of washing liquid equivalent to the fresh water amount is pumped out of the wash tank.

Normally, commercial dishwashers in the form of box-type dishwashers are equipped with multiple programs.

Said programs differ primarily in terms of differing lengths of program running times of the washing process. The operator has the option of selecting a short wash program in the case of lightly soiled items of washware or of selecting a correspondingly longer wash program in the case of heavily soiled items of washware. Furthermore, it is known to provide programs for cleaning glasses.

It is known in general from commercial dishwashing that the quality of the fresh water used for the final rinse and/or for washing the items of washware has a substantial influence on the overall dishwashing result, and therefore particular attention should be paid to the fresh water during commercial dishwashing. Reverse-osmosis technology is therefore used for high capacity utilization of dishwashers in catering and hotels and when there are simultaneously very exacting requirements for obtaining a blemish-free dishwashing result. By provision of water which is virtually 100 percent demineralized, the polishing of glasses and cutlery following cleaning and final rinsing of said items of washware in the dishwasher becomes superfluous.

In reverse-osmosis technology, the tap water to be demineralized is conducted in a closed system through a membrane under high pressure. Said osmotic membrane is of such a fine nature that it only passes through pure water (permeate) and retains dissolved substances, such as minerals and salts. The minerals originally situated in the water are concentrated and deposited as concentrate. The virtually completely mineral-free permeate is used for the dishwasher.

The present invention is based on the problem that dishwashers having a reverse-osmosis installation generally require an increased amount of space in order correspondingly to connect the reverse-osmosis installation to the dishwasher. Furthermore, the hydraulic connection of the reverse-osmosis installation to the dishwasher is generally relatively complicated.

In particular, it has not been possible up to now to connect a softener installation downstream of the reverse-osmosis installation in order to be able to soften, as required, the water to be fed to the dishwasher.

SUMMARY

On the basis of this problem, the present invention is based on the object of specifying a dishwasher which is in the form of a box-type dishwasher and with which, when required, the water to be used in the dishwasher can be correspondingly treated in a manner which is easy to realize but is nevertheless effective, in order not only to obtain faultless functioning of the machine, but also to obtain an optimum dishwashing result.

This object is achieved according to the invention by the subject matter of independent patent claim 1, wherein advantageous developments of the dishwasher according to the invention are indicated in the corresponding dependent claims.

According thereto, the invention relates in particular to a commercial dishwasher, which is designed in the form of a box-type dishwasher, wherein the dishwasher has a fresh-water connection with a feed valve, wherein a water-treatment system with a reverse-osmosis device is provided downstream of the feed valve in order to treat, in particular as required, at least some of the fresh water fed to the dishwasher via the fresh-water connection, wherein a backflow preventer is provided between the feed valve and the reverse-osmosis device in order to prevent water from flowing back from the dishwasher into a fresh-water-supply installation, such as, for example, the fresh-water-supply network, which is, or can be, flow-connected to the fresh-water connection of the dishwasher.

By means of the hydraulic configuration according to the invention of the dishwasher according to the invention, the reverse-osmosis device can be fully integrated in the dishwasher. The full integration of the reverse-osmosis device in the dishwasher considerably reduces the outlay on apparatus and control technology for implementing a corresponding water-treatment system. In contrast to the solutions known from the prior art, it is not provided in the present invention that the reverse-osmosis device operates as an independent device which functions on its own and is provided separately from the dishwasher; on the contrary, in the case of the solution according to the invention, the reverse-osmosis device is not only fully integrated in the dishwasher in a spatial respect but also in a functional respect.

The reverse-osmosis device which is fully integrated in the dishwasher according to the invention has a membrane module with an osmotic membrane which only lets through the carrier liquid (solvent) and retains the dissolved substances (solute). Since the membrane module or the osmotic membrane of the reverse-osmosis device serves for treating drinking water or water of drinking water quality, the osmotic membrane is preferably designed to let through only correspondingly fully demineralized water.

According to advantageous embodiments of the dishwasher according to the invention, the membrane module of the reverse-osmosis device has a fresh-water inlet which is, or can be, flow-connected to the backflow preventer of the dishwasher. Furthermore, the membrane module is equipped with a permeate outlet and with a concentrate outlet. A booster pump is preferably provided in the flow connection between the fresh-water inlet of the dishwasher and the membrane in order to provide the pressure necessary for the reverse osmosis at the fresh-water inlet of the membrane module. The booster pump is preferably configured to provide the fresh water to be treated at the fresh-water inlet of the membrane module of the reverse-osmosis device at a pressure of 3 to 30 bar.

In this connection, it is conceivable if, at the concentrate outlet of the membrane module, the pressure either is controlled via a pressure regulator or is used via a pressure exchanger in order to build up the necessary pressure in the feed of the system (fresh-water inlet of the membrane module). Such a pressure exchanger, by recycling energy, highly effectively reduces the operating costs of the dishwasher according to the invention with the reverse-osmosis device fully integrated therein.

In order to prevent damage of the osmotic membrane of the membrane module, a prefilter is advantageously provided upstream of the intake side of the booster pump (and/or a prefilter is provided between the delivery side of the booster pump and the fresh-water inlet of the membrane module). The prefilter can be a mechanical prefilter or else a carbon filter.

According to embodiments of the dishwasher according to the invention, the permeate outlet of the membrane module is, or can be, flow-connected to a water heater integrated in the dishwasher, wherein the concentrate outlet of the membrane module is, or can be, flow-connected to a drainage means of the dishwasher via an air-admission valve.

In order to minimize wear, in particular of the booster pump during operation of the reverse-osmosis device, it is of advantage if the flow connection between the backflow preventer and the reverse-osmosis device contains within it an air-extraction tank having a water inlet which is flow-connected to the backflow preventer, having a water outlet which is flow-connected to the reverse-osmosis device, and having an air-admission/air-extraction opening. The provision of such an air-extraction container ensures that degassed fresh water is fed in particular to the booster pump of the reverse-osmosis device, and therefore possible cavitation damage within the booster pump can be effectively prevented.

According to embodiments of the dishwasher according to the invention, the water-treatment system which is fully integrated in the dishwasher not only has a reverse-osmosis device, in order to fully demineralize the water to be used in the dishwasher, but also has a softener device which—like the reverse-osmosis device—is fully integrated in the dishwasher in a structural and functional respect and which serves to soften, as required, water to be used in the dishwasher. In this connection, it is in particular of advantage if the softener device can be, optionally, flow-connected in series with, and/or in parallel with, the reverse-osmosis device. This hydraulic circuit therefore makes it possible to operate the dishwasher according to the invention optionally with the softener device and the reverse-osmosis device or, as required, to switch on only the reverse-osmosis device or the softener device. It is thereby possible to react very flexibly to the particular use and the corresponding items of washware.

In one possible realization of the last-mentioned embodiment, in which, in addition to the reverse-osmosis device, a softener device is also fully integrated in the dishwasher according to the invention, it is provided that a water outlet of the softener device is, or can be, flow-connected to the intake side of a booster pump of the reverse-osmosis device, wherein the delivery side of the booster pump is flow-connected to a membrane module of the reverse-osmosis device and a permeate outlet of the module is flow-connected to a water heater which is integrated in the dishwasher. In this connection, there is furthermore preferably provided a bypass line, via which, as required, the water outlet of the softener device is, or can be, directly flow-connected to the water heater.

In an advantageous manner, a water inlet of the softener device here is, or can be, flow-connected to the backflow preventer of the dishwasher. It is appropriate here if the flow connection between the water inlet of the softener device and the backflow preventer of the dishwasher contains within it an air-extraction tank and/or a prefilter, in particular a mechanical prefilter or a carbon filter. The air-extraction tank here is intended to have a water inlet, which is flow-connected to the prefilter or the backflow preventer, a water outlet which is, or can be, flow-connected to the water inlet of the softener device, and an air-admission/air-extraction opening.

In embodiments of the dishwasher according to the invention, it is provided that the air-admission/air-extraction opening of the air-extraction tank is flow-connected, preferably via a nonreturn valve, to a line which opens out into the treatment chamber of the dishwasher, such as, for example, a line leading from a steam generator of the dishwasher into the treatment chamber of the dishwasher.

The fully integrated solution of the water-treatment system permits the housing of the dishwasher, in which not only the treatment chamber of the dishwasher, but also the water-treatment system of the dishwasher are structurally and functionally accommodated, to have only a single fresh-water connection leading into the housing and a single outflow leading out of the housing.

The invention furthermore relates to a method for operating a dishwasher as claimed in further independent patent claim 13.

BRIEF DESCRIPTION OF THE DRAWINGS

Exemplary embodiments of the dishwasher according to the invention will be described in more detail below.

In the drawings.

DETAILED DESCRIPTION

Figure 1:
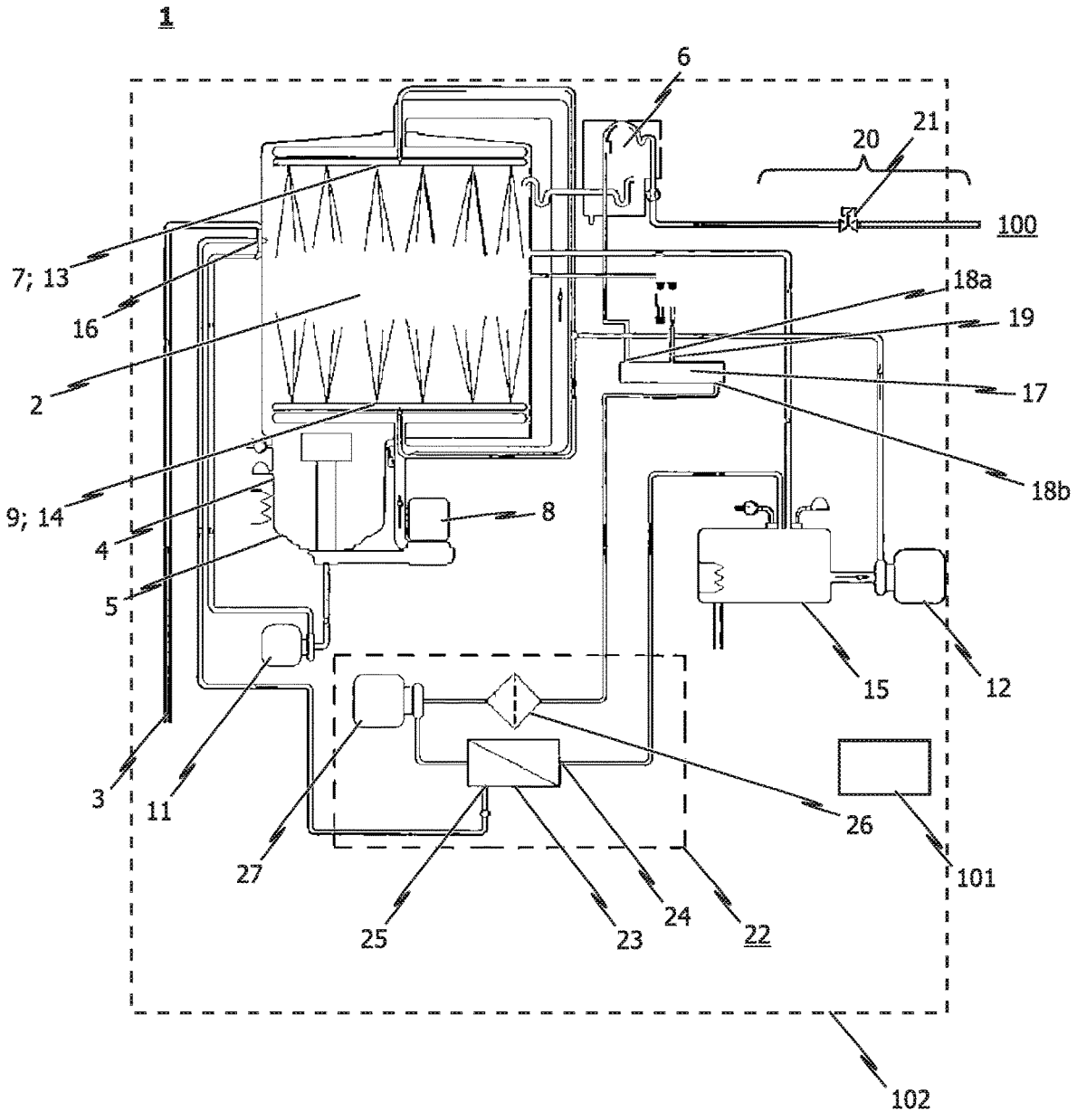
FIG. 1 shows a hydraulic diagram of a first exemplary embodiment of the dishwasher according to the invention with an integrated reverse-osmosis device.

The invention relates to commercial dishwashers, in particular crockery dishwashers or utensil dishwashers, in the form of a box-type dishwasher. They contain a program control device 101 for controlling at least one cleaning program, and a treatment chamber 2, which is closeable by a door (not shown) or a hood (not shown), in a machine housing 102 for receiving items of washware to be cleaned (not shown), such as crockery, cutlery, saucepans, pans and trays.

Located below the treatment chamber 2 is a wash tank 4 for receiving sprayed liquid from the treatment chamber 2. A wash pump 8 is provided for conveying washing liquid out of the wash tank 4 through a washing liquid line system to wash nozzles 7, 9 which are directed in the treatment chamber 2 onto the region of the items of washware to be cleaned and spray the washing liquid onto the items of washware to be cleaned. The sprayed washing liquid drops back into the wash tank 4 under the action of gravitational force. As a result, the wash tank 4, the wash pump 8, the washing liquid line system and the wash nozzles 7, 9 together with the treatment chamber 2 form a washing liquid circuit. The washing liquid line system here connects the delivery side of the wash pump 8 to the wash nozzles 7, 9.

Furthermore, a final rinse system is provided for conveying final rinse liquid by means of a final rinse pump 12 through a final rinse line system to final rinse nozzles 13, 14 which are directed in the treatment chamber 2 onto the region of the items of washware to be cleaned. The sprayed final rinse liquid drops from the treatment chamber 2 into the wash tank 4 under the action of gravitational force. The final rinse liquid line system connects the delivery side of the final rinse pump 12 to the final rinse nozzles 13, 14.

The wash nozzles 7, 9 and the final rinse nozzles 13, 14 can be arranged in the regions above and/or below and, if desired, also to the sides of the washware region within the treatment chamber 2 and are each directed towards the region in which the items of washware to be treated are positioned.

Preferably, a multiplicity of wash nozzles 7 are provided on at least one upper wash arm, a multiplicity of wash nozzles 9 are provided on at least one lower wash arm, a multiplicity of final rinse nozzles 13 are provided on at least one upper final rinse arm and a multiplicity of final rinse nozzles 14 are provided on at least one lower final rinse arm.

Before final rinse liquid is sprayed during the final rinse phase in the treatment chamber 2, an amount of washing liquid corresponding to the final rinse liquid is in each case pumped out of the wash tank 4 by means of a drain pump 11, the intake side of which is connected via a discharge line to a sump of the wash tank 4.

If the wash tank 4 is empty before an initial starting of the dishwasher 1 in the form of a box-type dishwasher, said wash tank 4 first of all has to be filled with fresh water via a fresh water supply line (not shown) or with fresh water or another final rinse liquid or washing liquid by means of the final rinse system and the final rinse pump 12 thereof.

The final rinse liquid can be fresh water, in particular fresh water prepared with the aid of a water-treatment system, which is fully integrated in the dishwasher 1, or fresh water mixed with final rinse agent, in particular fresh water which is mixed with final rinse agent and is treated via the fully integrated water-treatment system.

The washing liquid contains detergent which is metered, preferably automatically, from a detergent metering device (not shown) into the liquid contained in the wash tank 4.

The program control device 101 controls the wash pump 8, the final rinse pump 12, the drain pump 11 and a detergent solution pump (not shown) belonging to the detergent metering device depending on the cleaning program respectively selected at the program control device 101 by an operator. At least one cleaning program is provided, preferably a plurality of optionally selectable cleaning programs are provided.

The exemplary embodiment of the dishwasher 1 according to the invention according to the hydraulic diagram in FIG. 1 furthermore has a steam final rinse system which serves and is configured to generate or to provide steam as required and to conduct the generated or provided steam into the treatment chamber 2 of the dishwasher 1 during a steam final rinse phase. In this connection, it is conceivable if the steam final rinse system has a steam generator which is formed integrally in the water heater 15 of the dishwasher 1.

In detail, in the case of the embodiment of the dishwasher 1 according to the invention that is illustrated in FIG. 1, the final rinse pump 12 is connected by its intake side to an outlet of a water heater 15. The water heater 15 furthermore has an inlet which is, or can be, flow-connected to a fresh-water-supply installation 100 (such as, for example, a fresh-water-supply network) and via which fresh water is fed to the water heater 15 as required from the fresh-water-supply installation 100 after said fresh water has been treated as required in the water-treatment system integrated in the dishwasher 1 and/or after a final rinse agent has been metered into said fresh water as required. In the water heater 15, the liquid supplied via the inlet (treated fresh water with final rinse agent to be optionally metered in) is heated up in accordance with a process sequence. Via the final rinse pump 12, which is connected by its intake side to the outlet of the water heater 15, the final rinse liquid heated in the water heater 15 can be supplied, for example during a fresh-water final rinse phase, via the final rinse line system to the final rinse nozzles 13, 14. The final rinse nozzles 13, 14 are arranged in the treatment chamber 2 of the dishwasher 1 in order to spray the final rinse liquid, which is optionally heated in the water heater 15, onto the items of washware in the treatment chamber 2. Of course, however, it is also conceivable for treated fresh water to be supplied without final rinse agent metered therein to the water heater 15 via the inlet, wherein a final rinse agent is metered in after heating of the liquid in the water heater 15.

In the case of the embodiment of the dishwasher 1 according to the invention that is illustrated in FIG. 1, the steam final rinse system has a preferably electrically operated steam generator which, as illustrated in FIG. 1, can be integrated, for example, in the water heater 15. In this case, a corresponding steam outlet of the steam generator is formed at the upper region of the water heater 15. The steam outlet of the steam generator is connected via a steam line at a point located above the wash tank 4 to the treatment chamber 2 in order to introduce steam generated in the steam generator into the later when required. The outlet opening of the steam line is preferably located between the upper nozzles 7, 13 of the wash system or fresh water final rinse system and the lower nozzles 9, 14. Of course, however, other positions are also possible.

A heating system is located in the water heater 15 which, according to the embodiment illustrated in FIG. 1, serves not only for heating the final rinse liquid as required, but also for generating steam as required. Furthermore, a level sensor can be arranged in or on the water heater 15, the level sensor, for example, regulating the amount of treated fresh water which is supplied to the water heater 15 per unit of time.

The water-treatment system which is used in the dishwasher 1 according to the invention according to the hydraulic diagram in FIG. 1 and is fully integrated in the dishwasher has a reverse-osmosis device 22 which has a membrane module 23 with at least one osmotic membrane, and has a booster pump 27 and a prefilter 26. The prefilter 26 can be in form of a mechanical prefilter; however, it is of advantage to provide a carbon filter as the prefilter 26.

The membrane module 23 has a fresh water inlet, a permeate outlet 24 and a concentrate outlet 25. The permeate outlet 24 of the membrane module 23 is flow-connected to the inlet of the water heater 15 in order to supply fresh water treated in the reverse-osmosis device 22 to the water heater 15 as required or continuously.

The concentrate outlet 25 of the membrane module 23 is, or can be, flow-connected to the drain means of the dishwasher 1 via an air-admission valve 16. The delivery side of the drainage pump 11 of the dishwasher 1 is likewise connected to the air-admission valve 16 via a (separate) line. The outlet of the air-admission valve 16 is flow-connected via a single line to the drain means of the machine.

Although not illustrated in FIG. 1, it is conceivable if a pressure regulator is provided at the concentrate outlet 25 of the membrane module 23 in order to regulate or to control the pressure at the concentrate outlet. Alternatively or additionally thereto, it is conceivable to use the pressure at the concentrate outlet 25 of the membrane module 23 via a pressure exchanger in order to build up the pressure required in the feed of the membrane module 23 (at the fresh water inlet of the membrane module 23) and thereby to correspondingly relieve the booster pump 27 of load and to save energy or recycle energy.

In the case of the exemplary embodiment of the dishwasher according to the invention that is illustrated schematically in FIG. 1, a (single) fresh water connection 20 is provided via which the dishwasher 1 is flow-connected as required to the fresh-water-supply installation 100. Downstream of the fresh water connection 20, there is provided a backflow preventer 6 via which effectively a backflow of liquid into the fresh-water-supply installation 100 is actively prevented.

The fresh water connection 20 of the dishwasher can have a corresponding feed valve 21 and a corresponding fine filter.

The fresh-water outlet of the backflow preventer 6 is, or can be, flow-connected to the inlet of the reverse-osmosis device 22 and specifically to the inlet of the prefilter 26 of the reverse-osmosis device 22. In this case, a corresponding extraction of air from the fresh water should also be undertaken in the flow connection between the backflow preventer 6 and the reverse-osmosis device 22 in order to ensure that no cavitation can arise in the booster pump 27 of the reverse-osmosis device 22.

For this purpose, in the case of the exemplary embodiment according to FIG. 1, a corresponding air-extraction tank 17 is provided in the flow connection between the backflow preventer 6 and the reverse-osmosis device 22. Said air-extraction tank 17 has a water inlet **18*a* which is flow-connected to the outlet of the backflow preventer 6. Furthermore, the air-extraction container 17 has a water outlet 18*b* which is flow-connected to the reverse-osmosis device 22**.

In the air-extraction tank 17, the water fed to the tank 17 from the backflow preventer 6 or from the fresh-water-supply installation 100 is degassed. The gas (air) escapes out of the air-extraction tank 17 via a corresponding air-admission/air-extraction opening 19 and can then be introduced, for example via a line system, into the treatment chamber 2 of the dishwasher 1.

The advantages which can be obtained with the solution according to the invention are obvious: firstly, the invention supplies a compact dishwasher 1 with fully integrated reverse osmosis. Owing to the fully integrated solution, a considerable saving of space can be obtained in comparison to conventional solutions. Furthermore, the machine connections are reduced to a minimum. Furthermore, the dishwasher 1 conforms to all customary standards, in particular to DIN EN61770 (status: filing date).

Figure 2:
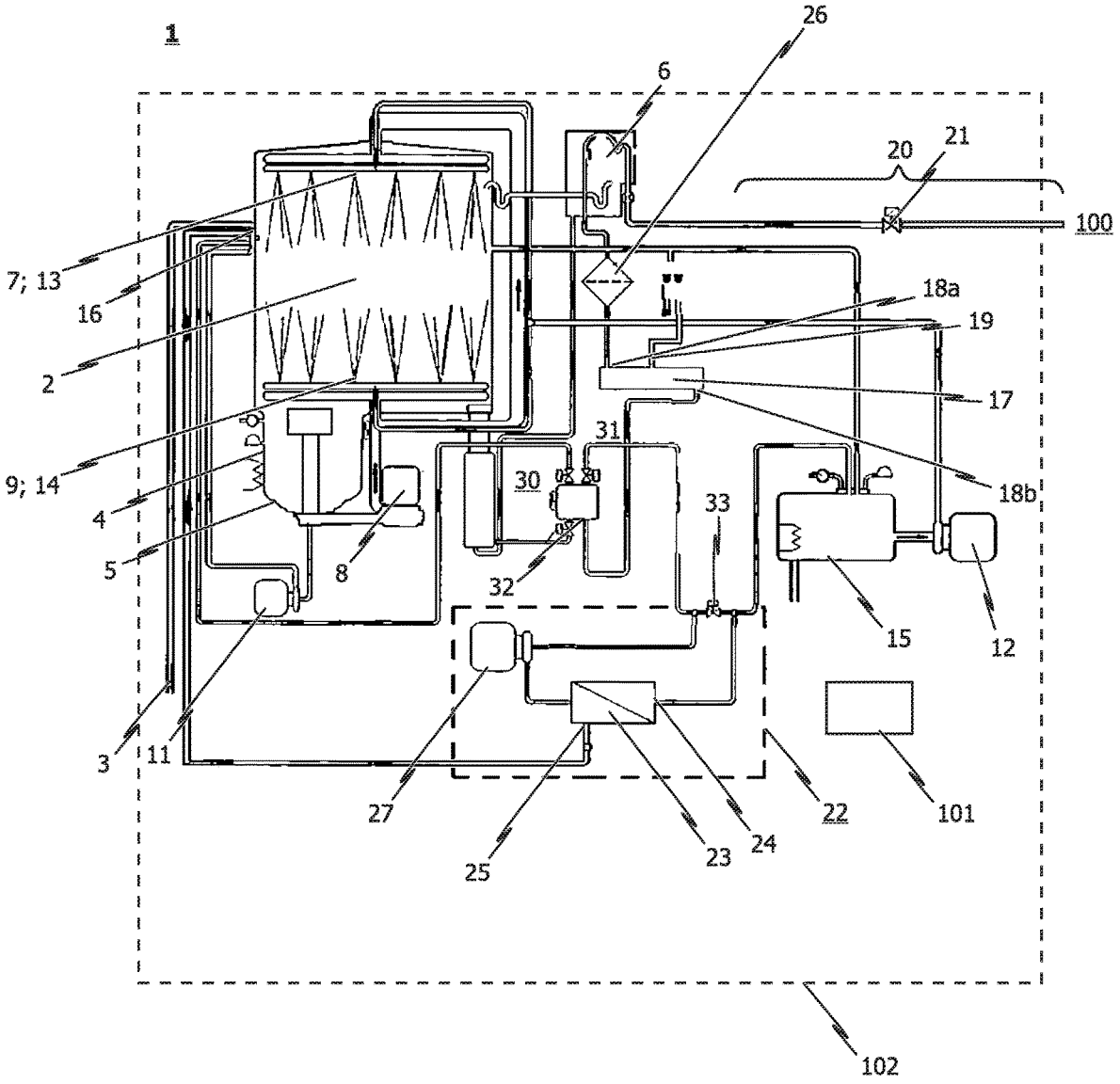
FIG. 2 shows a hydraulic diagram of a second exemplary embodiment of the dishwasher according to the invention with an integrated reverse-osmosis device and an integrated softener device.

FIG. 2 schematically shows a development of the dishwasher 1 according to the invention according to FIG. 1. In detail, it is provided in the exemplary embodiment according to FIG. 2 that the water-treatment system which is fully integrated in the dishwasher 1 not only has a reverse-osmosis device 22 but, in addition thereto, a softener device 30. The softening which is connected upstream in particular protects the osmotic membrane of the membrane module 23 of the reverse-osmosis device 22 against blockage. The invention is based here on the finding that hard water reduces the permeate capacity of the reverse-osmosis device 22 and shortens the service life of the membrane module 23. At the same time, the effect of a chemical detergent product and of a chemical final rinse agent is reduced by hard water because the chemical cleaning agent enters into chemical bonds with the hardness-causing minerals.

Furthermore, hard water can corrode the dishwasher 1 and can lead to limescale deposits on the heating elements during heating. This may greatly extend the program running time and the power of the dishwasher 1 is affected. If the hardness-causing minerals are not removed from the water, a firm limescale layer builds up around the heating elements. There is the risk in this case that ultimately the heating elements will burn through and the dishwasher will stop operating.

For this purpose, in the case of the dishwasher 1 according to FIG. 2, a softener device 30 is connected hydraulically upstream of the reverse-osmosis device 22. The softener device 30 can be connected here via the air-extraction tank 17 and the prefilter 26 or an additional prefilter 26 to the outlet of the backflow preventer 6.

The salt container belonging to the softener device 30 contains a suitable salt or a suitable chemical product with which a decomposition product arising in the water softener agent metered into the softener device 30 can be suitably regenerated. The salt container can be topped up with the salt or the chemical product from the treatment chamber 2 of the dishwasher 1 via an opening which is closeable with a lid.

The water outlet 31 of the softener device 30 is flow-connected to the intake side of the booster pump 27 of the reverse-osmosis device 22. The water outlet 31 of the softener device 30 can optionally also be directly flow-connected to the inlet of the water heater 15. For this purpose, a corresponding bypass line 33 is provided with an activatable bypass valve in order, as required, to connect the water outlet 31 of the softener device 30 directly to the water inlet of the water heater 15.

Both in the case of the embodiment according to FIG. 1 and in the case of the embodiment according to FIG. 2, it is provided that the activatable components of the water treatment system are controlled by the control device 101 of the dishwasher 1, preferably automatically and in particular according to a treatment program selected in the control device 101, and optionally depending on a detected quality of the washing liquid and/or of the fresh water provided at the fresh water connection 20 of the dishwasher 1.

The advantages which can be obtained with the exemplary embodiment of the dishwasher 1 according to the invention that is shown in FIG. 2 are obvious: firstly, the service life of the dishwasher 1 can be significantly extended because of the softener device 30. Similarly, there is no product restriction due to given regions of hardness. Furthermore, the functioning of the reverse-osmosis device 22 is always ensured.

The advantages which have already been discussed and can be obtained with the first embodiment according to FIG. 1 (compact and simple handling of the dishwasher 1, space saving, etc.) can, of course, also be obtained with the second embodiment according to FIG. 2.

The invention is not restricted to the exemplary embodiments of the dishwasher 1 that are shown in the drawings, but also arises from an overview of all the features disclosed herein.

The invention claimed is:

1. A box-type dishwasher, wherein the dishwasher has a fresh-water connection with a feed valve, wherein a water-treatment system with a reverse-osmosis device is provided downstream of the feed valve in order to treat at least some of the fresh water fed to the dishwasher via the fresh-water connection, wherein a backflow preventer is provided between the feed valve and the reverse-osmosis device in order to prevent water from flowing back from the dishwasher into a fresh-water-supply installation which is, flow-connected to the fresh-water connection;

wherein the reverse-osmosis device has a membrane module having a fresh-water inlet which is flow-connected to the backflow preventer, having a permeate outlet and having a concentrate outlet, wherein a prefilter and a booster pump are provided in a flow connection between the fresh-water inlet and the membrane module;

wherein a flow connection between the backflow preventer and the reverse-osmosis device contains within it an air-extraction tank having a water inlet which is flow-connected to the backflow preventer, and having a water outlet which is flow-connected to the fresh-water inlet of the reverse-osmosis device so as to deliver water through the prefilter and the booster pump prior to delivering water to the membrane module, the air-extraction tank further including an air-admission/air-extraction opening;

wherein the dishwasher has a housing, which accommodates a treatment chamber of the dishwasher and the reverse-osmosis device, wherein the dishwasher has a single fresh-water connection leading into the housing and a single outflow leading out of the housing.

2. The dishwasher as claimed in claim 1, wherein the permeate outlet of the membrane module flow-connected to a water heater integrated in the dishwasher, and wherein the concentrate outlet of the membrane module is, flow-connected to a drainage means of the dishwasher via an air-admission valve.

3. The dishwasher as claimed in claim 1, wherein a softener device is also provided in order to soften, as required, at least some of the fresh water fed to the dishwasher via the fresh-water connection, wherein the softener device can be, flow-connected in series with, and/or in parallel with, the reverse-osmosis device.

4. The dishwasher as claimed in claim 3, wherein a water outlet of the softener device is, flow-connected to an intake side of a booster pump of the reverse-osmosis device, wherein the delivery side of the booster pump is flow-connected to a membrane module of the reverse-osmosis device and a permeate outlet of the membrane module is flow-connected to a water heater which is integrated in the dishwasher, and wherein there is a bypass line provided, via which, the water outlet of the softener device is, directly flow-connected to the water heater.

5. The dishwasher as claimed in claim 3 or 4, wherein a water inlet of the softener device is, flow-connected to the backflow preventer of the dishwasher.

6. The dishwasher as claimed in claim 5, wherein the flow connection between the water inlet of the softener device and the backflow preventer of the dishwasher contains within it an air-extraction tank and/or a prefilter.

7. The dishwasher as claimed in claim 6, wherein the air-extraction tank has a water inlet, which is flow-connected to the prefilter or the backflow preventer, a water outlet, which is, flow-connected to the water inlet of the softener device, and an air-admission/air-extraction opening.

8. The dishwasher as claimed in claim 7, wherein the air-admission/air-extraction opening of the air-extraction tank is flow-connected, via a nonreturn valve, to a line which opens out into a treatment chamber of the dishwasher.

9. The dishwasher as claimed in claim 8, wherein the line which opens out into the treatment chamber of the dishwasher is flow-connected to a steam generator which is integrated in the dishwasher.

* * * * *